US012054864B2

(12) United States Patent
Yasui et al.

(10) Patent No.: US 12,054,864 B2
(45) Date of Patent: Aug. 6, 2024

(54) NETWORK STRUCTURE

(71) Applicant: TOYOBO CO., LTD., Osaka (JP)

(72) Inventors: Akifumi Yasui, Otsu (JP); Shinichi Kobuchi, Osaka (JP)

(73) Assignee: TOYOBO MC CORPORATION, Osaka (JP)

( * ) Notice: Subject to any disclaimer, the term of this patent is extended or adjusted under 35 U.S.C. 154(b) by 458 days.

(21) Appl. No.: 17/297,217

(22) PCT Filed: Nov. 27, 2019

(86) PCT No.: PCT/JP2019/046342
§ 371 (c)(1),
(2) Date: May 26, 2021

(87) PCT Pub. No.: WO2020/111110
PCT Pub. Date: Jun. 4, 2020

(65) Prior Publication Data

US 2022/0025561 A1 Jan. 27, 2022

(30) Foreign Application Priority Data

Nov. 29, 2018 (JP) ..... 2018-223515
Nov. 29, 2018 (JP) ..... 2018-223516

(51) Int. Cl.
*D04H 3/147* (2012.01)
*D04H 3/007* (2012.01)
*D04H 3/011* (2012.01)
*D04H 3/03* (2012.01)

(52) U.S. Cl.
CPC ..... *D04H 3/147* (2013.01); *D04H 3/007* (2013.01); *D04H 3/011* (2013.01); *D04H 3/03* (2013.01)

(58) Field of Classification Search
None
See application file for complete search history.

(56) References Cited

U.S. PATENT DOCUMENTS

| | | | |
|---|---|---|---|
| 7,622,179 | B2 | 11/2009 | Patel |
| 2015/0087196 | A1 | 3/2015 | Wakui et al. |
| 2016/0010250 | A1 | 1/2016 | Taninaka et al. |
| 2016/0251789 | A1 | 9/2016 | Taninaka et al. |
| 2016/0251790 | A1 | 9/2016 | Wakui et al. |
| 2018/0177306 | A1 | 6/2018 | Kobuchi et al. |
| 2018/0237968 | A1 | 8/2018 | Taninaka et al. |

FOREIGN PATENT DOCUMENTS

| | | | |
|---|---|---|---|
| CN | 104285003 | A | 1/2015 |
| CN | 105026632 | A | 11/2015 |
| CN | 105683434 | A | 6/2016 |
| CN | 105705695 | A | 6/2016 |
| CN | 107208340 | A | 9/2017 |
| CN | 107532355 | A | 1/2018 |
| EP | 2848721 | A1 | 3/2015 |
| JP | S55-16910 | A | 2/1980 |
| JP | 7-238457 | A | 9/1995 |
| JP | H08-61412 | A | 3/1996 |
| JP | 4413300 | B2 | 2/2010 |
| JP | 2013-76200 | A | 4/2013 |
| JP | 2016-141915 | A | 8/2016 |
| WO | 2016/093334 | A1 | 6/2016 |
| WO | 2018/012502 | A1 | 1/2018 |

OTHER PUBLICATIONS

Machine translation of JP2013076200 (Year: 2013).*
Machine translation of JPWO2016093334 (Year: 2017).*
Office Action dated Sep. 27, 2022, issued in counterpart IN Application No. 202117027707, with English Translation. (6 pages).
Office Action dated Sep. 17, 2021, issued in counterpart CN Application No. 201980078083.7, with English Translation. (11 pages).
International Search Report dated Mar. 3, 2020, issued in counterpart International Application No. PCT/JP2019/046342. (2 pages).
Office Action dated Jul. 28, 2020, issued in counterpart TW Patent Application No. 108143667, with English Translation. (14 pages).

* cited by examiner

*Primary Examiner* — Shawn Mckinnon
(74) *Attorney, Agent, or Firm* — WHDA, LLP

(57) ABSTRACT

The network structure has a three-dimensional random loop bonded structure composed of a thermoplastic elastomer continuous linear body having a fiber diameter of not less than 0.1 mm and not more than 3.0 mm, wherein the thermoplastic elastomer continuous linear body is complexed with a polyester-based thermoplastic elastomer and a polystyrene-based thermoplastic elastomer, and the network structure has a 70° C. compressive residual strain of not more than 35% and a rebound resilience of not more than 10%. Thereby, a network structure having a high vibration absorption property and being superior in thermal settling resistance is provided.

8 Claims, No Drawings

NETWORK STRUCTURE

TECHNICAL FIELD

The present invention relates to a network structure that exhibits a high vibration absorption property and is superior in thermal settling resistance, and also relates to a network structure suitable for a cushioning material to be used for seats for vehicles, beddings, etc. by utilizing the properties thereof.

BACKGROUND ART

PTL 1 (Japanese Patent Laying-Open No. 2013-76200) describes a network structure composed of a continuous linear body complexed with a resin composition containing a polyester-based thermoplastic elastomer and a resin composition containing a polystyrene-based thermoplastic elastomer. With this network structure, however, it has not been possible to obtain a network structure superior in both a vibration absorption property and thermal settling resistance.

CITATION LIST

Patent Literature

PTL 1: Japanese Patent Laying-Open No. 2013-76200

SUMMARY OF INVENTION

Technical Problem

An object of the present invention is to provide a network structure that exhibits a high vibration absorption property and is superior in thermal settling resistance.

Solution to Problem

As a result of diligent studies, the present inventors found that it is possible to obtain a network structure that exhibits a high vibration absorption property and is superior in thermal settling resistance by complexing a continuous linear body that constitutes a three-dimensional random loop bonded structure by using a specific thermoplastic elastomer, and thus have accomplished the present invention.

That is, the present invention includes the following configurations.

[1] A network structure having a three-dimensional random loop bonded structure composed of a thermoplastic elastomer continuous linear body having a fiber diameter of not less than 0.1 mm and not more than 3.0 mm, wherein the thermoplastic elastomer continuous linear body is complexed with a thermoplastic elastomer including a polyester-based thermoplastic elastomer and a polystyrene-based thermoplastic elastomer, and the network structure has a 70° C. compressive residual strain of not more than 35% and a rebound resilience of not more than 10%.

[2] The network structure according to the above [1], wherein the polyester-based thermoplastic elastomer has a rebound resilience of not less than 75%.

[3] The network structure according to the above [1], wherein the polyester-based thermoplastic elastomer has a Shore D hardness of not more than 40.

[4] The network structure according to any one of the above [1] to [3], wherein the polyester-based thermoplastic elastomer has a melting point of lower than 200° C.

[5] The network structure according to any one of the above [1] to [4] composed of the complexed thermoplastic elastomer continuous linear body in which a volume ratio of the polyester-based thermoplastic elastomer to the polystyrene-based thermoplastic elastomer is 90/10 to 10/90.

[6] The network structure according to any one of the above [1] to [5], wherein a complexed structure of the thermoplastic elastomer continuous linear body is a sheath-core structure or a side-by-side structure.

[7] The network structure according to any one of the above [1] to [6], wherein the polyester-based thermoplastic elastomer is at least one of a polyester ether block copolymer or a polyester ester block copolymer.

[8] The network structure according to any one of the above [1] to [7], wherein the polystyrene-based thermoplastic elastomer is at least one selected from the group consisting of a styrene-butadiene copolymer, a styrene-isoprene copolymer, and hydrogenated copolymers thereof.

[9] The network structure according to any one of the above [1] to [8], wherein the thermoplastic elastomer continuous linear body has a hollow cross section.

[10] The network structure according to any one of the above [1] to [9], wherein the thermoplastic elastomer continuous linear body has a modified cross section.

Advantageous Effects of Invention

The present invention relates to a network structure that exhibits a high vibration absorption property and is superior in thermal settling resistance, and it can be suitably used for seats for vehicles, beddings, etc. by virtue of its properties.

DESCRIPTION OF EMBODIMENTS

In the network structure of the present invention, a three-dimensional random loop bonded structure has been formed by curling a continuous linear body having a fiber diameter of not less than 0.1 mm and not more than 3.0 mm and made of a thermoplastic elastomer (this is sometimes referred to as "continuous linear body" in the present description), bringing the continuous linear body into contact with itself, and welding the contacted parts. Thereby, even when a large deformation is applied with a very large stress, the whole body of the network structure composed of the mutually welded three-dimensional random loop bonded structure will deform to absorb the stress. Furthermore, when the stress is removed, the network structure can recover its original shape due to the exhibition of the rubber elasticity of the thermoplastic elastomer. If the fiber diameter of the continuous linear body is less than 0.1 mm, the anti-compression strength lowers, and as a result, the repulsive force lowers. On the other hand, if the fiber diameter of the continuous linear body exceeds 3.0 mm, the compression resistance of individual continuous linear bodies is large, but the number of continuous linear bodies constituting the network structure is small, so that the force is poorly dispersed. In particular, when a remarkably large compressive force of not less than 100 kg/cm$^2$ is applied, settling due to stress concentration (permanent compression set) may occur, limiting the place of use. The fiber diameter is preferably not less than 0.3 mm and not more than 2.0 mm, and more preferably not less than 0.4 mm and not more than 1.5 mm. In the present invention, an optimal configuration can be formed by using not only continuous linear bodies having a single fiber diameter, but also continuous linear bodies having different fiber diameters in combination with apparent density.

The continuous linear body constituting the network structure of the present invention is complexed with a thermoplastic elastomer including a polyester-based thermoplastic elastomer and a polystyrene-based thermoplastic elastomer. As the polyester-based thermoplastic elastomer, it is preferable to use one having a rebound resilience of not less than 75%, or a Shore D hardness of not more than 40. Usually, the continuous linear body constituting the network structure is complexed for the purposes of enhancing the vibration absorption property of the network structure and enhancing the thermal settling resistance. In that case, a polystyrene-based thermoplastic elastomer having a rebound resilience of not more than 5% is used in order to enhance the vibration absorption property. Further, in order to enhance the thermal settling resistance, there is used (a) a polyethylene-based thermoplastic elastomer being high in melting point and low in rebound resilience or (b) a polyethylene-based thermoplastic elastomer being high in melting point, low in rebound resilience, and low in Shore D hardness. Then, both are used while being combined at an appropriate volume ratio. However, the present inventors found that the use of a polyester-based thermoplastic elastomer having a rebound resilience of not less than 75% or a Shore D hardness of not more than 40 and a relatively low melting point can enhance both the vibration absorption property and the thermal settling resistance, and thus they have accomplished the present invention. The melting point of the polyester-based thermoplastic elastomer is preferably lower than 200° C., more preferably lower than or equal to 195° C., and particularly preferably lower than or equal to 190° C. Further, from the viewpoint of the thermal settling resistance, the melting point is preferably higher than or equal to 150° C., more preferably higher than or equal to 155° C., and particularly preferably higher than or equal to 160° C.

Examples of the polyester-based thermoplastic elastomer for use in the present invention include a polyester ether block copolymer whose hard segment is a thermoplastic polyester and soft segment is a polyalkylene diol, and a polyester ester block copolymer whose hard segment is a thermoplastic polyester and soft segment is an aliphatic polyester. More specific examples of the polyester ether block copolymer are ternary block copolymers formed of at least one dicarboxylic acid selected from among aromatic dicarboxylic acids such as terephthalic acid, isophthalic acid, naphthalene-2,6-dicarboxylic acid, naphthalene-2,7-dicarboxylic acid and diphenyl-4,4'-dicarboxylic acid, alicyclic dicarboxylic acids such as 1,4-cyclohexane dicarboxylic acid, aliphatic dicarboxylic acids such as succinic acid, adipic acid, sebacic acid and dimer acid, and ester-forming derivatives of these dicarboxylic acids; at least one diol component selected from among aliphatic diols such as 1,4-butanediol, ethylene glycol, trimethylene glycol, tetramethylene glycol, pentamethylene glycol and hexamethylene glycol, alicyclic diols such as 1,1-cyclohexane dimethanol and 1,4-cyclohexane dimethanol, and ester-forming derivatives of these diols; and at least one polyalkylene diol selected from among polyethylene glycol, polypropylene glycol, polytetramethylene glycol and ethylene oxide-propylene oxide copolymers which have an average molecular weight of about 300 to about 5000. Examples of the polyester ester block copolymer include ternary block copolymers formed from the above-mentioned dicarboxylic acid and diol and at least one of polyester diols such as polylactone having an average molecular weight of about 300 to about 5000. In consideration of thermal bonding properties, hydrolysis resistance, flexibility, heat resistance, etc., preferred are (1) a ternary block copolymer formed from terephthalic acid and/or isophthalic acid as a dicarboxylic acid, 1,4-butanediol as a diol component, and polytetramethylene glycol as a polyalkylene diol and (2) a ternary block copolymer formed from terephthalic acid or/and naphthalene-2,6-dicarboxylic acid as a dicarboxylic acid, 1,4-butanediol as a diol component, and polylactone as a polyester diol. Particularly preferred is (1) a ternary block copolymer formed from terephthalic acid and/or isophthalic acid as a dicarboxylic acid, 1,4-butanediol as a diol component, and polytetramethylene glycol as a polyalkylene diol. In a special case, one to which a polysiloxane-based soft segment has been introduced can also be used.

The polyester-based thermoplastic elastomer for use in the present invention is not particularly limited, but is preferable to use a polyester-based thermoplastic elastomer having has a rebound resilience of not less than 75% or a Shore D hardness of not more than 40 from the viewpoint of exhibiting a high vibration absorption property while appropriately maintaining the thermal settling resistance of the network structure. When the rebound resilience of the polyester-based thermoplastic elastomer is not less than 75%, the impact received by the polyester-based thermoplastic elastomer can be easily transmitted to the polystyrene-based thermoplastic elastomer that constitutes the complexed continuous linear body together with the polyester-based thermoplastic elastomer. As a result, the vibration absorption property exhibited by the polystyrene-based thermoplastic elastomer is enhanced. The rebound resilience of the polyester-based thermoplastic elastomer is more preferably not less than 78%, and further preferably not less than 80%. When the Shore D hardness is not more than 40, the polyester-based thermoplastic elastomer is not excessively hard, and the impact absorption property of the polystyrene-based thermoplastic elastomer can be fully utilized. The Shore D hardness of the polyester-based thermoplastic elastomer is preferably not more than 38, more preferably not more than 36, and further preferably not more than 34.

The polystyrene-based thermoplastic elastomer for use in the present invention is not particularly limited, but it preferably has a rebound resilience of not more than 10% from the viewpoint of enhancing the vibration absorption property of the network structure. When the rebound resilience of the polystyrene-based thermoplastic elastomer is not more than 10%, a sufficient vibration damping property is exhibited and the vibration absorption property of the network structure is improved. The rebound resilience of the polystyrene-based thermoplastic elastomer is more preferably not more than 7%, and further preferably not more than 5%. Examples of the polystyrene-based thermoplastic elastomer having a rebound resilience of not more than 10% include a styrene-butadiene copolymer, a styrene-isoprene copolymer, and hydrogenated products thereof.

In addition, the complexed structure may be formed also using a third thermoplastic elastomer other than the polyester-based thermoplastic elastomer and the polystyrene-based thermoplastic elastomer as long as it is possible to maintain a high vibration absorption property and superior thermal settling resistance, which are the object of the present invention. Examples of the third thermoplastic elastomer include polyolefin-based thermoplastic elastomers.

The constitution ratio of the polyester-based thermoplastic elastomer to the polystyrene-based thermoplastic elastomer in the complexed continuous linear body constituting the network structure of the present invention is not particularly specified, but the volume ratio of the polyester-based thermoplastic elastomer to the polystyrene-based thermoplastic elastomer is preferably 95/5 to 5/95, more preferably 92/8 to 8/92, and even more preferably 90/10 to 10/90. When the volume ratio is 100/0 to 95/5 (excluding 95/5), it becomes difficult to maintain a high vibration absorption property. On the other hand, when the volume ratio is 5/95 to 0/100 (excluding 5/95), it becomes difficult to maintain high thermal settling resistance.

The network structure of the present invention has a rebound resilience of not more than 10% as measured by using a rebound resilience analyzer. If the rebound resilience exceeds 10%, the vibration absorption property of the network structure becomes insufficient. It is preferably not more than 7%, and more preferably not more than 5%.

In the present invention, the 70° C. compressive residual strain of the network structure is an index for evaluating the thermal settling resistance. The network structure of the present invention has a 70° C. compressive residual strain of not more than 35%, preferably not more than 30%, more preferably not more than 25%, even more preferably not more than 23%, particularly preferably not more than 20%, and most preferably not more than 18%. If the 70° C. compressive residual strain exceeds 35%, the thermal settling resistance, which is required, may be insufficient. The lower limit of the 70° C. compressive residual strain is not particularly specified, but it is not less than 1% in the network structure obtained by the present invention.

The network structure of the present invention preferably has a 25%-compression hardness of not less than 2.0 kg/φ200 mm. The 25%-compression hardness is a stress at 25%-compression on a stress-strain curve produced by compressing a network structure to 75% with a circular compression board measuring φ200 mm in diameter. When the 25%-compression hardness is less than 2.0 kg/φ200 mm, the cushioning property is impaired. It is more preferably not less than 2.5 kg/φ200 mm, and further preferably not less than 3.0 kg/φ200 mm. The upper limit is not particularly specified, but it is preferably not more than 30 kg/φ200 mm, more preferably not more than 25 kg/φ200 mm, and further preferably not more than 20 kg/φ200 mm. If it is not less than 30 kg/φ200 mm, the network structure becomes excessively hard, which is undesirable from the viewpoint of cushioning property.

The continuous linear body constituting the network structure of the present invention may contain various additives according to the intended purpose. Examples of the additives that can be added include plasticizers of phthalate type, trimellitate type, fatty acid type, epoxy type, adipate type and polyester type; antioxidants of known hindered phenol type, sulfur type, phosphorus type and amine type; light stabilizers of hindered amine type, triazole type, benzophenone type, benzoate type, nickel type and salicylic type; antistatic agents; molecule regulators such as peroxides; reactive group-containing compounds such as epoxy compounds, isocyanate compounds and carbodiimide compounds; metal deactivators; organic and inorganic nucleating agents; neutralizers; antacids; anti-microbial agents; fluorescent whitening agents; fillers; flame retardants; flame retardant aids; and organic and inorganic pigments.

The continuous linear body constituting the network structure of the present invention preferably has an endothermic peak at a temperature lower than or equal to the melting point in a melting curve produced by a differential scanning calorimeter. Those having an endothermic peak at a temperature lower than or equal to the melting point have significantly improved thermal settling resistance as compared to those having no endothermic peak. For example, a preferred polyester-based thermoplastic elastomer of the present invention is obtained by performing transesterification between an acid component of hard segment containing not less than 90 mol %, more preferably not less than 95 mol %, particularly preferably 100 mol % terephthalic acid and/or naphthalene-2,6-dicarboxylic acid, etc., which are rigid, and a glycol component; and thereafter performing polymerization to a necessary polymerization degree; and next performing copolymerization with a preferably not less than 10% by weight and not more than 70% by weight, more preferably not less than 20% by weight and not more than 60% by weight of polytetramethylene glycol, as polyalkylene diol, having an average molecular weight of preferably not less than 500 and not more than 5000, more preferably not less than 1000 and not more than 3000. In this case, if the acid component of the hard segment contains a large amount of terephthalic acid and/or naphthalene-2,6-dicarboxylic acid, which are rigid, the crystallinity of the hard segment is improved, the hard segment is unlikely to be plastically deformed, and the thermal settling resistance is improved. In addition, if an annealing treatment is performed at a temperature at least 10° C. lower than the melting point after thermal bonding, the thermal settling resistance is more improved. If the annealing is performed after a compressive strain is imparted, the thermal settling resistance is even more improved. The continuous linear body of the network structure subjected to such a treatment more clearly shows an endothermic peak at temperatures higher than or equal to room temperature and lower than or equal to the melting point, on the melting curve produced with a differential scanning calorimeter (DSC). In the case where the annealing is not performed, no endothermic peak appears at temperatures higher than or equal to room temperature and lower than or equal to the melting point on the melting curve. From this fact, it is assumed that the annealing causes rearrangement of the hard segment and forms quasi-crystal-like crosslinkages, and that this improves the thermal settling resistance (this annealing treatment may be hereinafter referred to as a "quasi-crystallization treatment.").

The continuous linear body constituting the network structure of the present invention is characterized by being complexed with a polyester-based thermoplastic elastomer and a polystyrene-based thermoplastic elastomer, and preferred complexed structures include a sheath-core structure and a side-by-side structure. The sheath-core structure is also called a core-sheath type, and can be classified into a concentric type and an eccentric type according to the positional relationship between the sheath and the core, and also can be classified into a circular cross section and a modified cross section as the cross-sectional shape; any combinations thereof are also available. The side-by-side structure is also called a parallel type and has a cross-sectional structure in which multiple components are bonded together. In both of the sheath-core structure and the side-by-side structure, the cross-sectional shape may be either hollow or solid.

When the complexed structure of the continuous linear body constituting the network structure of the present invention is a sheath-core structure, the ratio of the sheath component to the core component is preferably 95/5 to 5/95 in terms of volume ratio, more preferably 92/8 to 8/92, and even more preferably 90/10 to 10/90. When it is 100/0 to 95/5 (excluding 95/5) or 5/95 to 0/100 (excluding 5/95), it becomes difficult to exhibit complementary physical properties of the polyester-based thermoplastic elastomer and the polystyrene-based thermoplastic elastomer, so that it becomes difficult to achieve the object of the present invention, namely, high thermal settling resistance and a high vibration absorption property.

When the complexed structure of the continuous linear body constituting the network structure of the present invention is a side-by-side structure, there can be employed a structure in which the proportion of the surface of the linear body of either the polyester-based plastic elastomer or the polystyrene-based thermoplastic elastomer is made larger (for example, a structure in which the polyester-based plastic elastomer is arranged on the sheath of an eccentric sheath-core structure).

The present invention is characterized in that the continuous linear body is complexed. From the viewpoint of reducing the rebound resilience of the network structure, preferred is a continuous linear body in which not less than 50% of the surface of the linear body is occupied by a polyester-based thermoplastic elastomer having a rebound resilience of not less than 75% or a Shore D hardness of not more than 40. Among them, more preferred is a continuous linear body in which not less than 80% of the surface of the linear body is occupied by a polyester-based thermoplastic elastomer having a rebound resilience of not less than 75% or a Shore D hardness of not more than 40. Particularly preferred is a continuous linear body in which 100% of the surface of the linear body is occupied by a polyester-based thermoplastic elastomer having a rebound resilience of not less than 75% or a Shore D hardness of not more than 40, that is, a continuous linear body having a sheath-core structure.

The cross-sectional shape of the continuous linear body is not particularly limited. A hollow cross section or a modified cross section can impart compression resistance and bulkiness and thus are particularly preferred in the case where a small fiber diameter is demanded. The compression resistance can be adjusted depending on the modulus of a material to be used. In the case of a soft material, the gradient of initial compressive stress can be adjusted by increasing the degree of hollowness and/or degree of modification, and in the case of a material having a slightly high modulus, compression resistance that provides comfortableness to sit can be imparted by reducing the degree of hollowness and/or degree of modification. When the same compression resistance is imparted by increasing the degree of hollowness and/or the degree of modification as another effect derived from the hollow cross section or the modified cross section, it becomes possible to reduce the weight more.

In a specific embodiment of the network structure of the present invention, the preferable range of the apparent density is not less than 0.005 g/cm$^3$ and not more than 0.20 g/cm$^3$, in which the function as a cushioning material can be exhibited. If the apparent density is less than 0.005 g/cm$^3$, this is not suitable as a cushioning material because the repulsive force is lost, whereas if the apparent density exceeds 0.20 g/cm$^3$, this is undesirable because this leads to excessively high repulsive force and affords poor comfortableness to sit. The more preferable apparent density of the present invention is not less than 0.01 g/cm$^3$ and not more than 0.10 g/cm$^3$, and the more preferable range is not less than 0.03 g/cm$^3$ and not more than 0.06 g/cm$^3$. The network structure of the present invention can be provided with preferable properties by laminating a plurality of layers made of linear bodies with different fiber diameters and thereby varying the apparent density of the respective layers. For example, in the case of including a surface layer with a smaller fiber diameter and a base layer with a larger fiber diameter, it is possible to improve the comfortableness to sit by slightly increasing the density of the surface layer to increase the number of constituent fibers, thereby reducing the stress received by one linear body to improve the dispersion of the stress and improve the cushioning property that supports the buttocks. Since the base layer has a larger fiber diameter and is slightly harder to be a denser layer as a layer responsible for vibration absorption and body shape retention, it can be formed of a linear body with a slightly smaller fiber diameter and have a higher density. As a result, the vibration and repulsive stress received from the seat frame surface are uniformly transmitted to the base layer and the entire body is deformed to allow energy conversion, which makes it possible to improve the comfortableness to sit and the durability of the cushion. Moreover, for the purpose of imparting a thickness and tension to the side of a seat, the fiber diameter may be somewhat reduced partially and the density may be increased. In this way, each layer can arbitrarily select a preferable density and fiber diameter depending on its intended purpose. The thickness of each layer of the network structure is not particularly limited, and it is preferably not less than 3 mm, and more preferably not less than 5 mm, with which the function as a cushioning body is likely to be exhibited.

An outer surface of the network structure preferably has a surface layer portion in which a curled linear body is bent in the middle by not less than 30°, preferably not less than 45°, and the surface is substantially flattened, and most contacted parts are welded. This greatly increases the number of contacted points of the linear bodies in the surface of the network structure and forms bonded points. Therefore, local external force caused by the buttocks when a user sits down is received at the surface of the structure without feeling of a foreign substance in the buttocks, the whole surface structure undergoes deformation and the internal structure as a whole also undergoes deformation to absorb the stress, and, when the stress is removed, the rubber elasticity of the elastic resin is generated and the structure can recover its original shape. In the case where the surface is not substantially flattened, the buttocks may have feeling of a foreign substance, local external force may be applied to the surface, and the linear bodies and even the bonded points in the surface may selectively cause a concentrated stress. This concentrated stress may cause fatigue and a decrease in settling resistance. In the case where the outer surface of the structure is flattened, the surface of the structure may be covered with a side ground and the structure may be used for seats for vehicles, seats for trains, chairs or cushion mats for beds, sofas, mattresses and the like without the use of wadding layers or with a very thin wadding layer. In the case where the outer surface of the structure is not flattened, the surface of the network structure needs a stack of a relatively thick (preferably not less than 10 mm) wadding layer and needs to be covered with a side ground before the structure is made into a seat or a cushion mat. Bonding the structure to a wadding layer or a side ground according to need is easy in the case where the surface is flat. However, the bonding cannot be perfect in the case where the structure is not flattened because the surface is uneven.

Next, the following description discusses a method for producing a network structure including the three-dimensional random loop bonded structure of the present invention. The following method is one example and does not imply any limitation. The network structure of the present invention is produced by melt spinning. First, (1) the discharged molten linear bodies are curled and brought into contact with each other, and most of the contacted parts are welded to form a three-dimensional structure, and (2) this is sandwiched by a take-up device. Next, (3) it is cooled in a cooling bath to form a network structure. In the present invention, in order to successfully complex a discharged linear body with a polyester-based thermoplastic elastomer and a polystyrene-based thermoplastic elastomer, the respective thermoplastic elastomers are distributed in front of each nozzle orifice. The thermoplastic elastomers are discharged downward through the nozzle at a melting temperature being higher than or equal to a temperature 10° C. higher than the melting point of the higher melting point component of the thermoplastic elastomers and being lower than or equal to a temperature 120° C. higher than the melting point of the lower melting point component, whereby a network structure made up of a continuous linear body complexed by the above-described method is produced from the discharged molten complexed linear body.

The polyester-based thermoplastic elastomer and the polystyrene-based thermoplastic elastomer are separately melted using common melt-extruders, and distributed and merged in the same manner as a common conjugate spinning method so as to be complexed immediately before the orifice, and then the complexed linear body is discharged. When spinning a continuous linear body having a sheath-core structure, the core component is fed from the center, and the sheath component is merged from around the core component, and then discharged. When spinning a continuous linear body having a side-by-side structure, the respective components are merged from the left and the right or from the front and the back, and then discharged. As to the melting temperature applied at this time, unless the melting is performed at a temperature that is lower than or equal to a temperature 120° C. higher than the melting point of the lower melting point component, significant thermal decomposition undesirably occurs and the properties of the thermoplastic resin are impaired. On the other hand, unless the temperature is adjusted to be higher than or equal to a temperature 10° C. higher than the melting point of the higher melting point component, melt fracture occurs and normal linear formation cannot be performed. Further, in the case of a side-by-side structure, the linear bodies may be poorly bonded. The melting temperature is preferably higher than or equal to a temperature 20° C. higher than the melting point of the lower melting point component and lower than or equal to a temperature that is 100° C. higher than the melting point of the lower melting point component, and more preferably higher than or equal to a temperature 30° C. higher than the melting point of the lower melting point component and lower than or equal to a temperature that is 80° C. higher than the melting point of the lower melting point component. The elastomers are merged and discharged at the same melting temperature within a range of higher than or equal to a temperature 15° C. higher than the melting point of the higher melting point component and lower than or equal to a temperature that is 40° C. higher than the melting point of the higher melting point component, and more preferably higher than or equal to a temperature 20° C. higher than the melting point of the higher melting point component and lower than or equal to a temperature 30° C. higher than the melting point of the higher melting point component. Unless the melting temperature difference immediately before merging is lower than or equal to 10° C., abnormal flow may occur and the formation of the complexed form may be damaged.

The shape of the orifice is not particularly limited, and when a modified cross section (for example, a shape capable of achieving a high cross-sectional secondary moment, such as a triangle, a Y shape, and a star shape) or a hollow cross section (for example, a triangular hollow, a round hollow, and a hollow with a protrusion) is applied, this is particularly preferable because this makes the three-dimensional structure formed by the discharged molten linear body difficult to flow and be relaxed, and conversely, that allows the flow time at the contacted points to be maintained long and can strengthen the contacted points. When the heating for bonding described in Japanese Patent Laying-Open No. 1-2075 is performed, this is undesirable because a three-dimensional structure is easily relaxed and turns into a two-dimensional structure, so that it becomes difficult to form a three-dimensional structure. As the effects of improving the properties of the structure, the apparent bulkiness can be increased and the weight can be reduced, and moreover, the compression resistance is improved and the resilience can also be improved, so that the structure becomes less likely to settle. In the case of a hollow cross section, when the hollowness exceeds 80%, the cross section is easily crushed. Therefore, when a hollow cross section is employed, the hollowness is preferably not less than 10% and not more than 70%, with which the effect of weight reduction can be exhibited, and more preferably not less than 20% and not more than 60%.

The pitch between the holes of the orifices needs to be a pitch that allows a sufficient contact between loops formed by the linear body. The pitch between the holes is reduced in order to form a structure high in the density of the continuous linear body, whereas the pitch between the holes is increased in order to form a structure low in the density of the continuous linear body. The pitch between holes in the present invention is preferably 3 mm to 20 mm, and more preferably 5 mm to 10 mm. In the present invention, different densities and/or different fiber diameters may be achieved as desired. Layers having different densities can be formed by, for example, a configuration in which the pitch between lines or the pitch between holes is also changed, or a method of changing both the pitch between lines and the pitch between holes. Furthermore, different fiber diameters can be achieved by making use of the principle in which, when a pressure loss difference at the time of discharge is imparted by changing the cross sectional areas of the orifices, the amount of molten thermoplastic elastomer which is discharged with a constant pressure through a single nozzle is smaller in the case of an orifice with larger pressure loss.

Next, opposite outer surfaces of the molten three-dimensional structure are sandwiched between take-up nets, discharged molten continuous linear bodies curled in the opposite outer surfaces are bent and deformed by not less than 30°, whereby the outer surfaces are flattened while the contacted points with non-bent discharged linear bodies are bonded and a structure is formed. After that, the structure is rapidly cooled continuously with a cooling medium (usually, water at room temperature is preferably used because this allows for quick cooling and also low costs) to thereby obtain a network structure including the three-dimensional random loop bonded structure of the present invention. Next, the network structure is drained and dried. Here, the addition of a surfactant, etc. to the cooling medium is not preferable because this may make it difficult to drain and/or dry the network structure or this may cause swelling of the thermoplastic elastomer. A preferred method of the present invention includes performing a quasi-crystallization treatment after cooling. The temperature for the quasi-crystallization treatment is at least 10° C. lower than the melting point (Tm), and the quasi-crystallization treatment is performed at a temperature equal to or higher than the temperature (Tαcr) at the leading edge of a dispersion of Tans. This treatment causes the network structure to have an endothermic peak at or lower than the melting point, and remarkably improves the thermal settling resistance of the network structure as compared to one that has not been subjected to the quasi-crystallization treatment (having no endothermic peak). The preferred temperature for the quasi-crystallization treatment in the present invention is from (Tαcr+10° C.) to (Tm−20° C.). The quasi-crystallization by a mere heat treatment improves the thermal settling resistance. Further, it is more preferable to, after once cooling, apply compression deformation of not less than 10% and annealing because this remarkably improves the thermal settling resistance. Furthermore, when a drying step is performed after cooling, the drying temperature can be set as the annealing temperature, whereby the quasi-crystallization treatment can be performed at the same time. Alternatively, the quasi-crystallization treatment may be performed separately.

Next, the network structure is cut into a desired length or shape and used as a cushioning material. In the case of using the network structure of the present invention for a cushioning material, the resins to be used, fiber diameter, loop diameter, and bulk density need to be selected according to the purposes of use and the parts for use. For example, in the case where the network structure is used for surface wadding, a smaller fiber diameter and a fine diameter of loops with a lower density are preferably used in order to exhibit bulkiness having soft touch, moderate sinking and tension. In the case where the network structure is used as a middle portion cushioning body, a density of middle degree, a larger fiber diameter, and a little larger diameter of loops are preferred, in order to exhibit a superior lower frequency of sympathetic vibration, a moderate hardness, good retention capacity of body shape by linear variation of hysteresis in compression, and to maintain durability. Of course, in order to make needed performance suitable for the intended usage, the network structure may also be in combination with other materials, for example, combination with hard cotton cushioning materials including staple fiber packed materials, and nonwoven fabrics. Furthermore, as long as the performance is not reduced, there may be given treatment processing of chemicals addition for functions of flame-resistance, insect control antibacterial treatment, heat-resistance, water and oil repelling, coloring, fragrance, etc. in any stage of a process from the production to the molding and commercialization, even other than in the resin production process.

EXAMPLES

Hereinafter, the present invention will be described by way of Examples. The evaluations in Examples were performed in the following manner.

<Properties of Resin>

(1) Rebound Resilience

The rebound resilience was measured in accordance with JIS K 6255.

(2) Melting Point

Using a TA50, DSC50 differential thermal analyzer manufactured by Shimadzu Corporation, the endothermic peak (melting peak) temperature was determined from the endothermic-exothermic curve measured from 20° C. to 250° C. at a temperature elevation rate of 20° C./min for 10 g of a sample.

(3) Shore D Hardness

The Shore D hardness was measured in accordance with ASTM D2240.

<Properties of Network Structure>

(4) 25%-Compression Hardness

A sample is cut into a size of 30 cm×30 cm, and the cut sample is left standing under an environment of 20° C.±2° C. with no load for 24 hours, the central part of the sample is then compressed at a speed of 10 mm/min with a φ200 mm compression board having a thickness of 10 mm using a Tensilon (RTG-1310) manufactured by A&D Co., Ltd., which is placed under an environment of 20° C.±2° C., and the thickness at a load of 1.0 N is measured as a hardness-meter thickness. The position of the compression board at this time is defined as a zero position, and the sample is compressed to 75% of the hardness-meter thickness at a speed of 100 mm/min, followed by returning the compression board to the zero point at a speed of 100 mm/min. Subsequently, the sample is compressed to 25% of the hardness-meter thickness at a speed of 100 mm/min, and the load at this time was measured as a 25%-compression hardness. The 25%-compression hardness was shown with the unit of kg/φ200 mm, using the average value of n=3.

(5) Fiber Diameter of Continuous Linear Body

A sample was cut into a size of 10 cm in the width direction×10 cm in the length direction×sample thickness, and ten linear bodies were collected by a length of about 5 mm randomly in the thickness direction from the cut cross section. The collected linear bodies were observed with an optical microscope with an appropriate magnification, focusing on a fiber diameter measurement point, to measure the fiber thickness as viewed from the fiber side face. Since the surface of the network structure is made flat to obtain smoothness, the fiber cross section may be deformed. For this reason, it was decided not to collect a specimen in a region within 2 mm from the surface of the network structure.

(6) Hollowness of Continuous Linear Body

A continuous linear body was collected from a network structure, cooled with liquid nitrogen, and thereafter was cut into pieces. A cross section of each piece was observed under an electron microscope at a magnification of 50 times, the obtained image was analyzed using a CAD system and thereby the cross sectional area (A) of a resin portion and the cross sectional area (B) of a hollow portion were measured, and the hollowness was calculated using the formula $\{B/(A+B)\}\times 100$.

(7) 70° C. Compressive Residual Strain

A sample was cut into a size of 10 cm×10 cm×sample thickness, and the sample, whose thickness $t_b$ before compression has been measured, was sandwiched in a tool capable of holding the sample in a 50%-compression state, placed in a dryer set at 70° C.±2° C., and left standing for 22 hours. Then, the sample was taken out and the compression strain was removed, and the sample was cooled at room temperature (25° C.) and left standing for 30 minutes. Then, the thickness after compression, $t_a$, was measured, and the 70° C. compressive residual strain was calculated from the formula $(t_b-t_a)/t_b\times 100$ (unit: %, average of n=3). Here, for the thickness before compression to and the thickness after compression $t_b$, each of the samples before compression and the samples after compression was measured the height thereof at one point, and the averages of the measurements were taken as the thicknesses.

(8) Rebound Resilience of Network Structure

A sample is cut into a size of 10 cm in the width direction×10 cm in the length direction×sample thickness, and the cut sample is left standing under an environment of 20° C.±2° C. with no load for 24 hours, the sample is then compressed at a speed of 10 mm/min with a φ200 mm compression board having a thickness of 10 mm using a Tensilon (RTG-1310) manufactured by A&D Co., Ltd. placed under an environment of 20° C.±2° C., and the thickness at a load of 5.0 N is measured. The position of the compression board at this time is defined as a zero point, and the sample is compressed to 75% of the hardness-meter thickness at a speed of 100 mm/min, followed by returning the compression board to the zero point at a speed of 100 mm/min. As a continuous operation, the sample is compressed to 75% of the hardness-meter thickness at a speed of 100 mm/min, and the compression board is returned to the zero point at a speed of 100 mm/min. After allowing the sample to stand for 15 minutes, a columnar weight with a diameter of 80 mm and a weight of 600 g is dropped from a height of 15 cm, the height of the initial rebound is measured, and the rebound resilience is calculated from the following formula. The height of the rebound was measured with a high-speed digital camera (average of n=3).

$$\text{Rebound resilience}(\%)=(\text{rebound height}(\text{cm})/15\ (\text{cm}))\times 100$$

(9) Apparent Density

A sample is cut into a size of 15 cm×15 cm, the height is measured at four points and the volume is calculated. The apparent density is represented by the value ($g/cm^3$) obtained by dividing the weight of the sample by the volume. (Average of n=4)

Synthesis Example 1

Dimethyl terephthalate (DMT), 1,4-butanediol (1,4-BD) and polytetramethylene glycol (PTMG: average molecular weight 2000) were charged together with a small amount of a catalyst, transesterification was performed by a conventional method, and thereafter the resultant was subjected to polycondensation with increasing temperature under reduced pressure, whereby a polyester-ether block copolymer elastomer of DMT/1,4-BD/PTMG=100/75/25 (molar ratio) was prepared. Next, 1% antioxidant was added thereto, and the resultant was mixed and kneaded, and thereafter the mixture was pelletized. The pellets were dried in vacuo at 50° C. for 48 hours, whereby a polyester-based thermoplastic elastomer (A-1) was obtained. The properties of the product are shown in Table 1.

Synthesis Example 2

Dimethyl terephthalate (DMT), 1,4-butanediol (1,4-BD) and polytetramethylene glycol (PTMG: average molecular weight 1000) were charged together with a small amount of a catalyst, transesterification was performed by a conventional method, and thereafter the resultant was subjected to polycondensation with increasing temperature under reduced pressure, whereby a polyester-ether block copolymer elastomer of DMT/1,4-BD/PTMG=100/71.8/28.2 (molar ratio) was prepared. Next, 1% antioxidant was added thereto, and the resultant was mixed and kneaded, and thereafter the mixture was pelletized. The pellets were dried in vacuo at 50° C. for 48 hours, whereby a polyester-based thermoplastic elastomer (A-2) was obtained. The properties of the product are shown in Table 1.

Synthesis Example 3

Dimethyl terephthalate (DMT), 1,4-butanediol (1,4-BD) and polytetramethylene glycol (PTMG: average molecular weight 1000) were charged together with a small amount of a catalyst, transesterification was performed by a conventional method, and thereafter the resultant was subjected to polycondensation with increasing temperature under reduced pressure, whereby a polyester-ether block copolymer elastomer of DMT/1,4-BD/PTMG=100/84/16 (molar ratio) was prepared. Next, 1% antioxidant was added thereto, and the resultant was mixed and kneaded, and thereafter the mixture was pelletized. The pellets were dried in vacuo at 50° C. for 48 hours, whereby a polyester-based thermoplastic elastomer (A-3) was obtained. The properties of the product are shown in Table 1.

TABLE 1

| | Elastomer name | Elastomer composition (molar ratio) | Elastomer properties: Melting point | Rebound resilience | Shore D hardness |
|---|---|---|---|---|---|
| Synthesis Example 1 | A-1 | DMT/1,4-BD/PTMG = 100/75/25 | 180° C. | 81 | 31 |
| Synthesis Example 2 | A-2 | DMT/1,4-BD/PTMG = 100/71.8/28.2 | 172° C. | 78 | 38 |
| Synthesis Example 3 | A-3 | DMT/1,4-BD/PTMG = 100/84/16 | 200° C. | 71 | 46 |

Example 1

The polyester-based thermoplastic elastomer (A-1) obtained in Synthesis Example 1 and a hydrogenated styrene-butadiene random copolymer (TPS) ("S.O.E.S1611" manufactured by Asahi Kasei Chemicals Corporation), which is a polystyrene-based thermoplastic elastomer, were each melted at 240° C., and were merged before orifices in a volume ratio of 30/70 such that sheath/core was A-1/TPS. The merged flow was discharged at 240° C. at a total discharge rate of 1000 g/min through a nozzle provided with orifices having a hole diameter of 1.0 mm for forming round hollow cross-sectional continuous linear bodies wherein the holes were arranged with a pitch between lines in the length direction of 5 mm and a pitch between holes in the width direction of 10 mm on a nozzle effective face of 50 cm in width and 5 cm in length. Cooling water was placed at a position 25 cm under the nozzle face. Endless nets made of stainless steel and having a width of 60 cm were disposed parallel at an interval of 5 cm to form a pair of take-up conveyors, partially exposed over a water surface. The discharged continuous linear body was taken up on the conveyors, while being welded on the contacted parts of the continuous linear body, and sandwiched from both sides. The sandwiched material was introduced into cooling water at 25° C. at a speed of 0.66 m/minute to solidify. Then, the material was subjected to a quasi-crystallization treatment for 20 minutes in a hot air dryer at 105° C., and then cut into a prescribed size, whereby a network structure composed of continuous linear bodies having a complexed structure was obtained. The properties of the obtained network structure are shown in Table 2.

Example 2

A network structure was obtained in the same manner as in Example 1 except that the polyester-based thermoplastic elastomer (A-1) obtained in Synthesis Example 1 and the hydrogenated styrene-butadiene random copolymer (TPS) ("S.O.E.S1611" manufactured by Asahi Kasei Chemicals Corporation), which is a polystyrene-based thermoplastic elastomer, were used in a volume ratio of 50/50 such that sheath/core was A-1/TPS. The properties of the obtained network structure are shown in Table 2.

Example 3

A network structure was obtained in the same manner as in Example 1 except that the polyester-based thermoplastic elastomer (A-1) obtained in Synthesis Example 1 and the hydrogenated styrene-butadiene random copolymer (TPS) ("S.O.E.S1611" manufactured by Asahi Kasei Chemicals Corporation), which is a polystyrene-based thermoplastic elastomer, were used in a volume ratio of 10/90 such that sheath/core was A-1/TPS. The properties of the obtained network structure are shown in Table 2.

Example 4

A network structure was obtained in the same manner as in Example 1 except that the polyester-based thermoplastic elastomer (A-2) obtained in Synthesis Example 2 and the hydrogenated styrene-butadiene random copolymer (TPS) ("S.O.E.S1611" manufactured by Asahi Kasei Chemicals Corporation), which is a polystyrene-based thermoplastic elastomer, were used in a volume ratio of 50/50 such that sheath/core was A-2/TPS. The properties of the obtained network structure are shown in Table 2.

Comparative Example 1

A network structure was obtained in the same manner as in Example 1 except that the polyester-based thermoplastic elastomer (A-3) obtained in Synthesis Example 3 and the hydrogenated styrene-butadiene random copolymer (TPS) ("S.O.E.S1611" manufactured by Asahi Kasei Chemicals Corporation), which is a polystyrene-based thermoplastic elastomer, were used in a volume ratio of 30/70 such that sheath/core was A-3/TPS. The properties of the obtained network structure are shown in Table 2.

Comparative Example 2

A network structure was obtained in the same manner as in Comparative Example 1 except that the volume ratio was changed to 70/30. The properties of the obtained network structure are shown in Table 2.

Comparative Example 3

A hydrogenated styrene-butadiene random copolymer (TPS) ("S.O.E.S1611" manufactured by Asahi Kasei Chemicals Corporation), which is a polystyrene-based thermoplastic elastomer, was melted at 240° C., and was discharged at 240° C. at a total discharge rate of 1000 g/min through a nozzle provided with orifices having a hole diameter of 1.0 mm for forming round hollow cross-sectional continuous linear bodies wherein the holes were arranged with a pitch between lines in the width direction of 5.2 mm and a pitch between lines in the length direction of 6.0 mm on a nozzle effective face of 65 cm in width and 5 cm in length. Cooling water was placed at a position 25 cm under the nozzle face. Endless nets made of stainless steel and having a width of 70 cm were disposed parallel at an interval of 5 cm to form a pair of take-up conveyors, partially exposed over a water surface. The discharged continuous body was taken up on the conveyors, while being welded on the contacted parts of the continuous linear body, and sandwiched from both sides. The sandwiched material was introduced into cooling water at a speed of 0.66 m/minute to solidify. Then, the material was subjected to a quasi-crystallization treatment for 15 minutes in a hot air dryer at 70° C., and then cut into a prescribed size, whereby a network structure was obtained. The properties of the obtained network structure are shown in Table 2.

Comparative Example 4

A network structure was obtained in the same manner as in Comparative Example 3 except that the polyester-based thermoplastic elastomer (A-3) obtained in Synthesis Example 3 was used instead of the hydrogenated styrene-butadiene random copolymer (TPS), which is a polystyrene-based thermoplastic elastomer, and the temperature of the hot air dryer was changed to 105° C. The properties of the obtained network structure are shown in Table 2.

Comparative Example 5

A network structure was obtained in the same manner as in Comparative Example 3 except that the polyester-based thermoplastic elastomer (A-2) obtained in Synthesis Example 2 was used instead of the hydrogenated styrene-butadiene random copolymer (TPS), which is a polystyrene-based thermoplastic elastomer, the temperature of the hot air dryer was changed to 105° C., and the discharge temperature was changed to 220° C. The properties of the obtained network structure are shown in Table 2.

Comparative Example 6

A network structure was obtained in the same manner as in Comparative Example 2 except that the polyester-based thermoplastic elastomer (A-1) obtained in Synthesis Example 1 was used instead of the hydrogenated styrene-butadiene random copolymer (TPS), which is a polystyrene-based thermoplastic elastomer, the temperature of the hot air dryer was changed to 105° C., and the discharge temperature was changed to 220° C. The properties of the obtained network structure are shown in Table 2.

TABLE 2

| | Resin composition of continuous linear body (volume ratio) | | | | | | |
|---|---|---|---|---|---|---|---|
| | Polyester-based thermoplastic elastomer | | | Polystyrene-based thermoplastic elastomer | Complexed structure form of continuous | Cross-sectional shape of continuous | Hollowness |
| | A-1 | A-2 | A-3 | TPS | linear body | linear body | (%) |
| Example 1 | 30 | 0 | 0 | 70 | Sheath/core A-1/TPS | Round hollow | 32 |

TABLE 2-continued

| | | | | | | | |
|---|---|---|---|---|---|---|---|
| Example 2 | 50 | 0 | 0 | 50 | Sheath/core A-1/TPS | Round hollow | 35 |
| Example 3 | 10 | 0 | 0 | 90 | Sheath/core A-1/TPS | Round hollow | 34 |
| Example 4 | 0 | 50 | 0 | 50 | Sheath/core A-2/TPS | Round hollow | 32 |
| Comparative Example 1 | 0 | 0 | 30 | 70 | Sheath/core A-3/TPS | Round hollow | 31 |
| Comparative Example 2 | 0 | 0 | 70 | 30 | Sheath/core A-3/TPS | Round hollow | 30 |
| Comparative Example 3 | 0 | 0 | 0 | 100 | — | Round hollow | 30 |
| Comparative Example 4 | 0 | 0 | 100 | 0 | — | Round hollow | 31 |
| Comparative Example 5 | 0 | 100 | 0 | 0 | — | Round hollow | 31 |
| Comparative Example 6 | 100 | 0 | 0 | 0 | — | Round hollow | 31 |

| | Continuous linear body Diameter (mm) | Rebound resilience (%) | Apparent density (g/cm$^3$) | 70° C. Compressive residual strain (%) | 25%-Compression hardness (kg/φ200 mm) |
|---|---|---|---|---|---|
| Example 1 | 0.95 | 0 | 0.064 | 16.7 | 4.0 |
| Example 2 | 0.92 | 0 | 0.065 | 15.4 | 7.2 |
| Example 3 | 1.00 | 0 | 0.063 | 17.9 | 3.2 |
| Example 4 | 0.96 | 5 | 0.065 | 15.1 | 9.6 |
| Comparative Example 1 | 0.93 | 11 | 0.050 | 12.3 | 10.5 |
| Comparative Example 2 | 0.89 | 36 | 0.052 | 12.2 | 17.3 |
| Comparative Example 3 | 1.05 | 0 | 0.050 | 49.8 | 2.8 |
| Comparative Example 4 | 0.42 | 52 | 0.050 | 12.0 | 25.0 |
| Comparative Example 5 | 0.41 | 55 | 0.052 | 11.1 | 18.6 |
| Comparative Example 6 | 0.40 | 56 | 0.050 | 10.8 | 4.4 |

Example 5

The polyester-based thermoplastic elastomer (A-1) obtained in Synthesis Example 1 and a hydrogenated styrene-butadiene random copolymer (TPS) ("S.O.E.S1611" manufactured by Asahi Kasei Chemicals Corporation), which is a polystyrene-based thermoplastic elastomer, were each melted at 240° C., and were merged before orifices in a volume ratio of 40/60 such that sheath/core was A-1/TPS. The merged flow was discharged at 240° C. at a total discharge rate of 1000 g/min through a nozzle provided with orifices having a hole diameter of 1.0 mm for forming round hollow cross-sectional continuous linear bodies wherein the holes were arranged with a pitch between lines in the length direction of 5 mm and a pitch between holes in the width direction of 10 mm on a nozzle effective face of 50 cm in width and 5 cm in length. Cooling water was placed at a position 25 cm under the nozzle face. Endless nets made of stainless steel and having a width of 60 cm were disposed parallel at an interval of 5 cm to form a pair of take-up conveyors, partially exposed over a water surface. The discharged continuous linear body was taken up on the conveyors, while being welded on the contacted parts of the continuous linear body, and sandwiched from both sides. The sandwiched material was introduced into cooling water at 25° C. at a speed of 0.66 m/minute to solidify. Then, the material was subjected to a quasi-crystallization treatment for 20 minutes in a hot air dryer at 105° C., and then cut into a prescribed size, whereby a network structure composed of continuous linear bodies having a complexed structure was obtained. The properties of the obtained network structure are shown in Table 3.

Example 6

A network structure was obtained in the same manner as in Example 5 except that the polyester-based thermoplastic elastomer (A-1) obtained in Synthesis Example 1 and the hydrogenated styrene-butadiene random copolymer (TPS) ("S.O.E.S1611" manufactured by Asahi Kasei Chemicals Corporation), which is a polystyrene-based thermoplastic elastomer, were used in a volume ratio of 60/40 such that sheath/core was A-1/TPS. The properties of the obtained network structure are shown in Table 3.

Example 7

A network structure was obtained in the same manner as in Example 5 except that the polyester-based thermoplastic elastomer (A-1) obtained in Synthesis Example 1 and the hydrogenated styrene-butadiene random copolymer (TPS) ("S.O.E.S1611" manufactured by Asahi Kasei Chemicals Corporation), which is a polystyrene-based thermoplastic elastomer, were used in a volume ratio of 20/80 such that sheath/core was A-1/TPS. The properties of the obtained network structure are shown in Table 3.

Example 8

A network structure was obtained in the same manner as in Example 5 except that the polyester-based thermoplastic elastomer (A-2) obtained in Synthesis Example 2 and the hydrogenated styrene-butadiene random copolymer (TPS) ("S.O.E.S1611" manufactured by Asahi Kasei Chemicals Corporation), which is a polystyrene-based thermoplastic elastomer, were used in a volume ratio of 60/40 such that sheath/core was A-2/TPS. The properties of the obtained network structure are shown in Table 3.

Comparative Example 7

A network structure was obtained in the same manner as in Example 5 except that the polyester-based thermoplastic elastomer (A-3) obtained in Synthesis Example 3 and the hydrogenated styrene-butadiene random copolymer (TPS) ("S.O.E.S1611" manufactured by Asahi Kasei Chemicals Corporation), which is a polystyrene-based thermoplastic elastomer, were used in a volume ratio of 40/60 such that sheath/core was A-3/TPS. The properties of the obtained network structure are shown in Table 3.

Comparative Example 8

A network structure was obtained in the same manner as in Comparative Example 7 except that the volume ratio was changed to 60/40. The properties of the obtained network structure are shown in Table 3.

Comparative Example 9

A hydrogenated styrene-butadiene random copolymer (TPS) ("S.O.E.S1611" manufactured by Asahi Kasei Chemicals Corporation), which is a polystyrene-based thermoplastic elastomer, was melted at 240° C., and was discharged at 240° C. at a total discharge rate of 1000 g/min through a nozzle provided with orifices having a hole diameter of 1.0 mm for forming round hollow cross-sectional continuous linear bodies wherein the holes were arranged with a pitch between holes in the width direction of 5.2 mm and a pitch between holes in the length direction of 6.0 mm on a nozzle effective face of 65 cm in width and 5 cm in length. Cooling water was placed at a position 25 cm under the nozzle face. Endless nets made of stainless steel and having a width of 70 cm were disposed parallel at an interval of 5 cm to form a pair of take-up conveyors, partially exposed over a water surface. The discharged continuous body was taken up on the conveyors, while being welded on the contacted parts of the continuous linear body, and sandwiched from both sides. The sandwiched material was introduced into cooling water at a speed of 0.66 m/minute to solidify. Then, the material was subjected to a quasi-crystallization treatment for 15 minutes in a hot air dryer at 70° C., and then cut into a prescribed size, whereby a network structure was obtained. The properties of the obtained network structure are shown in Table 3.

Comparative Example 10

A network structure was obtained in the same manner as in Comparative Example 9 except that the polyester-based thermoplastic elastomer (A-3) obtained in Synthesis Example 3 was used instead of the hydrogenated styrene-butadiene random copolymer (TPS), which is a polystyrene-based thermoplastic elastomer, and the temperature of the hot air dryer was changed to 105° C. The properties of the obtained network structure are shown in Table 3.

Comparative Example 11

A network structure was obtained in the same manner as in Comparative Example 9 except that the polyester-based thermoplastic elastomer (A-2) obtained in Synthesis Example 2 was used instead of the hydrogenated styrene-butadiene random copolymer (TPS), which is a polystyrene-based thermoplastic elastomer, and the temperature of the hot air dryer was changed to 105° C. The properties of the obtained network structure are shown in Table 3.

Comparative Example 12

A network structure was obtained in the same manner as in Comparative Example 9 except that the polyester-based thermoplastic elastomer (A-1) obtained in Synthesis Example 1 was used instead of the hydrogenated styrene-butadiene random copolymer (TPS), which is a polystyrene-based thermoplastic elastomer, and the temperature of the hot air dryer was changed to 105° C. The properties of the obtained network structure are shown in Table 3.

TABLE 3

| | Resin composition of continuous linear body (volume ratio) | | | | | | |
|---|---|---|---|---|---|---|---|
| | Polyester-based thermoplastic elastomer | | | Polystyrene-based thermoplastic elastomer | Complexed structure form of continuous | Cross-sectional shape of continuous | Hollowness |
| | A-1 | A-2 | A-3 | TPS | linear body | linear body | (%) |
| Example 5 | 40 | 0 | 0 | 60 | Sheath/core A-1/TPS | Round hollow | 33 |
| Example 6 | 60 | 0 | 0 | 40 | Sheath/core A-1/TPS | Round hollow | 34 |
| Example 7 | 20 | 0 | 0 | 80 | Sheath/core A-1/TPS | Round hollow | 33 |
| Example 8 | 0 | 60 | 0 | 40 | Sheath/core A-2/TPS | Round hollow | 31 |
| Comparative Example 7 | 0 | 0 | 40 | 60 | Sheath/core A-3/TPS | Round hollow | 32 |
| Comparative Example 8 | 0 | 0 | 60 | 40 | Sheath/core A-3/TPS | Round hollow | 31 |
| Comparative Example 9 | 0 | 0 | 0 | 100 | — | Round hollow | 30 |

TABLE 3-continued

| | | | | | | | |
|---|---|---|---|---|---|---|---|
| Comparative Example 10 | 0 | 0 | 100 | 0 | — | Round hollow | 31 |
| Comparative Example 11 | 0 | 100 | 0 | 0 | — | Round hollow | 31 |
| Comparative Example 12 | 100 | 0 | 0 | 0 | — | Round hollow | 31 |

| | Continuous linear body Diameter (mm) | Rebound resilience (%) | Apparent density (g/cm$^3$) | 70° C. Compressive residual strain (%) | 25%-Compression hardness (kg/φ200 mm) |
|---|---|---|---|---|---|
| Example 5 | 0.95 | 0 | 0.064 | 16.8 | 5.6 |
| Example 6 | 0.92 | 0 | 0.065 | 15.4 | 6.4 |
| Example 7 | 0.97 | 0 | 0.063 | 17.9 | 3.6 |
| Example 8 | 0.95 | 8 | 0.066 | 14.7 | 12.5 |
| Comparative Example 7 | 0.94 | 13 | 0.051 | 12.1 | 10.8 |
| Comparative Example 8 | 0.90 | 28 | 0.052 | 11.9 | 15.3 |
| Comparative Example 9 | 1.05 | 0 | 0.050 | 49.8 | 2.8 |
| Comparative Example 10 | 0.42 | 52 | 0.050 | 12.0 | 25.0 |
| Comparative Example 11 | 0.41 | 55 | 0.052 | 11.1 | 18.6 |
| Comparative Example 12 | 0.40 | 56 | 0.050 | 10.8 | 4.4 |

It should be considered that the embodiments and examples disclosed here are exemplary in all respects and are not restrictive in any way. The scope of the present invention is defined not by the above-described embodiments and examples but by the claims, and is intended to include all modifications within the meaning and scope equivalent to the claims.

INDUSTRIAL APPLICABILITY

The network structure of the present invention is a network structure that exhibits a high vibration absorption property and is superior in thermal settling resistance, and can be suitably used for seats for vehicles, beddings, etc. by virtue of its characteristics.

The invention claimed is:

1. A network structure having a three-dimensional random loop bonded structure composed of a thermoplastic elastomer continuous linear body having a fiber diameter of not less than 0.1 mm and not more than 3.0 mm, wherein the thermoplastic elastomer continuous linear body is complexed with a thermoplastic elastomer including a polyester-based thermoplastic elastomer and a polystyrene-based thermoplastic elastomer, and the network structure has a 70° C. compressive residual strain of not more than 35% and a rebound resilience of not more than 10%, wherein the polyester-based thermoplastic elastomer has a melting point of lower than 200° ° C., and wherein the polyester-based thermoplastic elastomer has a Shore D hardness of not more than 40.

2. The network structure according to claim 1, wherein the polyester-based thermoplastic elastomer has a rebound resilience of not less than 75%.

3. The network structure according to claim 1, which is composed of the complexed thermoplastic elastomer continuous linear body in which a volume ratio of the polyester-based thermoplastic elastomer to the polystyrene-based thermoplastic elastomer is 90/10 to 10/90.

4. The network structure according to claim 1, wherein a complexed structure of the thermoplastic elastomer continuous linear body is a sheath-core structure or a side-by-side structure.

5. The network structure according to claim 1, wherein the polyester-based thermoplastic elastomer is at least one of a polyester ether block copolymer or a polyester ester block copolymer.

6. The network structure according to claim 1, wherein the polystyrene-based thermoplastic elastomer is at least one selected from the group consisting of a styrene-butadiene copolymer, a styrene-isoprene copolymer, and hydrogenated copolymers thereof.

7. The network structure according to claim 1, wherein the thermoplastic elastomer continuous linear body has a hollow cross section.

8. The network structure according to claim 1, wherein the thermoplastic elastomer continuous linear body has a modified cross section.

* * * * *